US007784385B2

(12) United States Patent
Wang

(10) Patent No.: US 7,784,385 B2
(45) Date of Patent: Aug. 31, 2010

(54) SPLITTER FOR CIRCULAR TABLE SAW

(76) Inventor: Henry Wang, 660 Sumter Ct., Winter Springs, FL (US) 32708

( * ) Notice: Subject to any disclaimer, the term of this patent is extended or adjusted under 35 U.S.C. 154(b) by 0 days.

(21) Appl. No.: 11/937,051

(22) Filed: Nov. 8, 2007

(65) Prior Publication Data

US 2008/0053281 A1 Mar. 6, 2008

Related U.S. Application Data

(63) Continuation of application No. 10/979,939, filed on Nov. 2, 2004, now Pat. No. 7,293,488.

(60) Provisional application No. 60/517,293, filed on Nov. 4, 2003, provisional application No. 60/604,241, filed on Aug. 25, 2004.

(51) Int. Cl.
*B27B 5/06* (2006.01)

(52) U.S. Cl. ..... 83/102.1; 83/477.2; 30/371

(58) Field of Classification Search ..... 83/102.1, 83/440.2, 477.2, 478, 544; 30/371, 373; 144/253.1

See application file for complete search history.

(56) References Cited

U.S. PATENT DOCUMENTS

| | | | | |
|---|---|---|---|---|
| 129,193 | A * | 7/1872 | Tompkins | 83/102.1 |
| 421,861 | A | 2/1890 | French | |
| 482,507 | A | 9/1892 | Foster | |
| 565,940 | A | 9/1896 | Stevens | |
| 816,326 | A | 3/1906 | Hill | |
| 2,593,596 | A | 4/1952 | Olson | |
| 3,566,934 | A | 3/1971 | Thrasher | |
| 3,583,450 | A | 6/1971 | Gunnerman | |
| 3,775,020 | A | 11/1973 | Stoutenberg | |
| 4,516,612 | A | 5/1985 | Wiley | |
| 4,534,112 | A | 8/1985 | Bass | |
| D282,237 | S | 1/1986 | Warburg | |
| 4,625,604 | A | 12/1986 | Handler et al. | |
| 4,896,708 | A | 1/1990 | Dietz | |
| 5,146,964 | A | 9/1992 | Dietz | |
| 5,253,686 | A | 10/1993 | Dietz | |
| 5,287,779 | A | 2/1994 | Metzger, Jr. | |
| 5,447,085 | A | 9/1995 | Gochnauer | |
| 6,170,370 | B1 | 1/2001 | Sommerville | |
| 6,405,624 | B2 | 6/2002 | Sutton | |

(Continued)

OTHER PUBLICATIONS

Tools Plus Internet web page illustrating Merlin splitter, (Nov. 2007).

*Primary Examiner*—Stephen Choi
(74) *Attorney, Agent, or Firm*—David G. Maire; Beusse Wolter Sanks Mora & Maire, P.A.

(57) ABSTRACT

A splitter for installation behind a rotating blade of a table saw to prevent contact between the kerf of a work piece and the upwardly moving rear portion of the saw blade. The splitter is indexed from the side of an actual kerf rather than from a side of the saw blade. In this manner, variations in kerf width resulting from variations in blade width and vibration of the saw blade are accommodated. Splitters having work piece contacting surfaces with incremental amounts of offset relative to the side of the kerf may be selected to provide a desired degree of interference and resulting force between the splitter and the work piece.

8 Claims, 14 Drawing Sheets

U.S. PATENT DOCUMENTS 6,463,922 B2 10/2002 Petitjean
6,578,460 B2 6/2003 Sartori
6,715,388 B1 4/2004 Jaksha
6,736,042 B2 5/2004 Behne et al.
7,234,380 B2 * 6/2007 Garcia ..... 83/102.1

* cited by examiner

SPLITTER FOR CIRCULAR TABLE SAW

RELATED APPLICATIONS

This application is a continuation of U.S. patent application Ser. No. 10/979,939 filed on 2 Nov. 2004, now U.S. Pat. No. 7,293,488 issued on 13 Nov. 2007, which in turn claims benefit of the 4 Nov. 2003 filing date of U.S. provisional patent application No. 60/517,293 and the 25 Aug. 2004 filing date of U.S. provisional patent application No. 60/604,241, both of which are incorporated by reference herein.

FIELD OF THE INVENTION

This invention relates generally to the field of woodworking, and more specifically to a splitter for use with a table saw.

BACKGROUND OF THE INVENTION

It is known to position a splitter device behind the circular saw blade of a table saw to maintain separation of the cut material by virtue of its location in the kerf. The term behind is used herein to mean downstream of the saw blade in the direction of movement of a work piece past the blade. Splitters generally consist of a thin piece of metal supported in the plane of the saw blade. A splitter functions to prevent the cut portion of the material from rubbing against the upwardly moving rear portion of the saw blade, which could result in dangerous kickback of the work piece and/or charring of the work piece surface. Various types and arrangements of splitters are well known in the art. See for example, U.S. Pat. No. 482,507 which issued on Sep. 13, 1892.

Modern table saws are often provided with a combination splitter, anti-kickback pawl and guard. Certain table saw operations require the removal of such combination devices due to physical interferences, such as the guard interfering with narrow ripping, the guard and the anti-kickback pawls obstructing tenon cutting when the board is vertically oriented, and the anti-kickback pawls causing binding on certain type of cross cutting. The removal and reinstallation of such devices is often troublesome and time consuming, such as with combination devices shown in U.S. Pat. Nos. 4,625,604 and 6,405,624. Many table saw owners permanently remove their splitter combination devices to avoid such inconvenience.

FIG. 1 is a top view illustration of a prior art splitter being used on a table saw. A saw blade 10 extends through a saw slot in a work surface 12 upon which a work piece 14 is supported. As the work piece 14 is urged past the saw blade 10, a saw cut or kerf 16 is created that separates the off-cut piece 18 from the keeper piece 20. Straight line movement of the work piece 14 past the saw blade 10 is ensured by keeping an alignment edge 22 of the work piece 14 against a rip fence 24, which is, in turn, securely supported to extend above the work surface 12 in a plane parallel to the saw blade 10. Splitter 26 is supported in a position behind the saw blade 10 and extends above the work surface 12 within the kerf 16.

Proper alignment of the splitter 26 relative to the saw blade 10 is known to be important for proper functioning of the splitter 26. A splitter on a circular table saw is generally thinner than the saw blade and the kerf it creates. If the splitter 26 is directly centered behind the saw blade 10, a small gap will exist between the splitter 26 and the off-cut piece 18 as well as between the splitter 26 and the keeper piece 20. Such gaps reduce the effectiveness of the splitter by allowing the respective portions of the work piece to move toward the saw blade 10. Often, such a splitter 26 is aligned and installed to be flush with the side of the saw blade 10 facing the rip fence 24 to deny the keeper piece 20 from contacting the saw blade 10. However, precise alignment of a splitter relative to a saw blade is known to be a difficult task. One known method of alignment is to place a straight edge against the side of the saw blade, then to affix the splitter into position against the straight edge. This method achieves alignment of one side of the splitter with one side of the saw blade; however, it augments the gap remaining between the other side of the splitter and the other side of the saw blade.

Splitters that maintain contact with both the off-cut piece 18 and the keeper piece 20 are also known. U.S. Pat. No. 6,715,388 issued on Apr. 6, 2004, describes a rotatable splitter holder mounted behind a saw blade. The position of a splitter pin extending into the kerf above the holder is controlled by the rotation of the holder. Two pins may be positioned on the holder, one on each opposed side of the axis of rotation, to make contact with both the off-cut piece and the keeper piece. The rotation of such a two-pin holder will change the width between the pins within the kerf, thereby accommodating various widths of saw blades. U.S. Pat. No. 3,566,934 issued on Mar. 2, 1971, describes a splitter that includes a plurality of resilient contacts that project toward the opposed sides of the kerf to make contact with both the off-cut piece and the keeper piece. If such dual-contact splitters are not precisely centered behind the saw blade, excessive contact pressure may be exerted against one side of the kerf, while inadequate or no pressure may be exerted against the opposed side.

BRIEF DESCRIPTION OF THE DRAWINGS

The invention is explained in following description in view of the drawings that show.

DETAILED DESCRIPTION OF THE INVENTION

The present inventor has recognized that prior art splitter designs fail to provide the precision that is desired by highly skilled wood workers. Prior art splitter designs and installation techniques focus on the saw blade in its stationary, non-rotating condition. In reality, every saw blade will create a kerf that is somewhat wider than the width of the stationary blade due to vibration induced in the blade as it rotates, unevenly installed saw teeth, and/or the rip fence not being parallel to the saw blade. Furthermore, this variation in kerf width may vary from blade to blade of the same type. The present invention overcomes this problem with an innovative splitter design and installation technique, as described more fully below.

Figure 1:
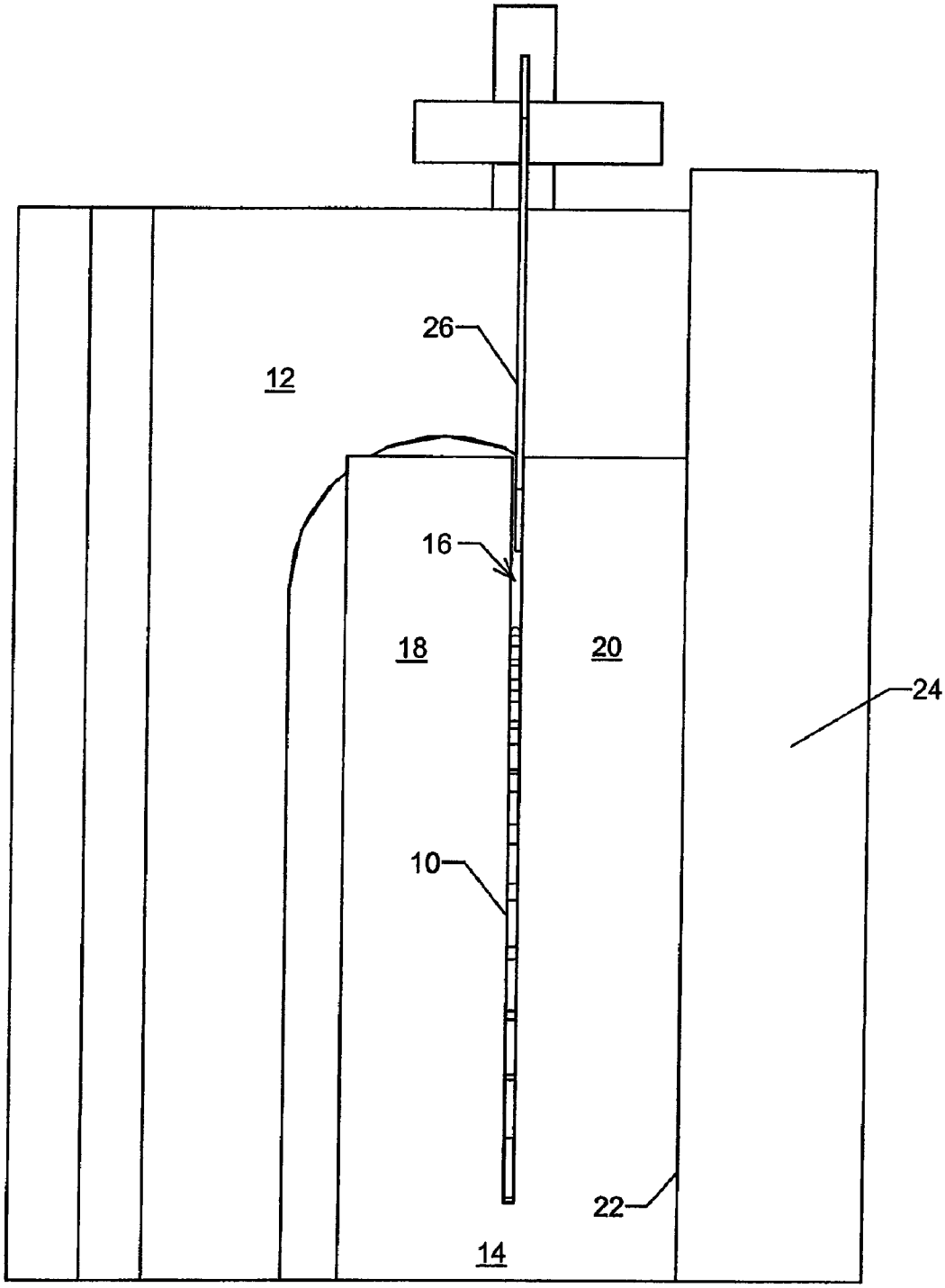
FIG 1 PRIOR ART
FIG. 1 is a top view of a saw table with a prior art splitter being used to cut a work piece.
Figure 2:
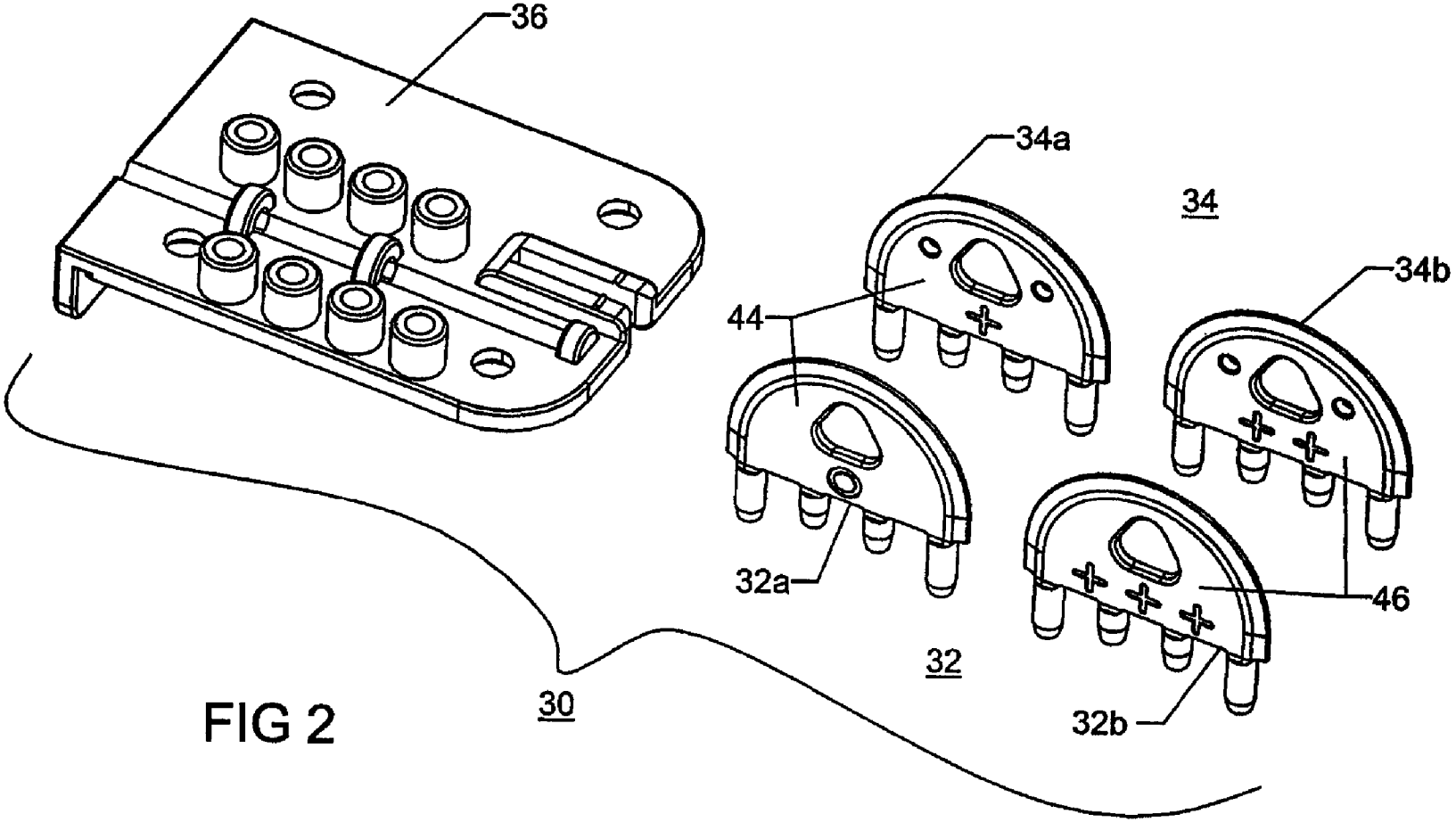
FIG. 2 illustrates a kit containing splitters and a drill guide.
Figure 3:
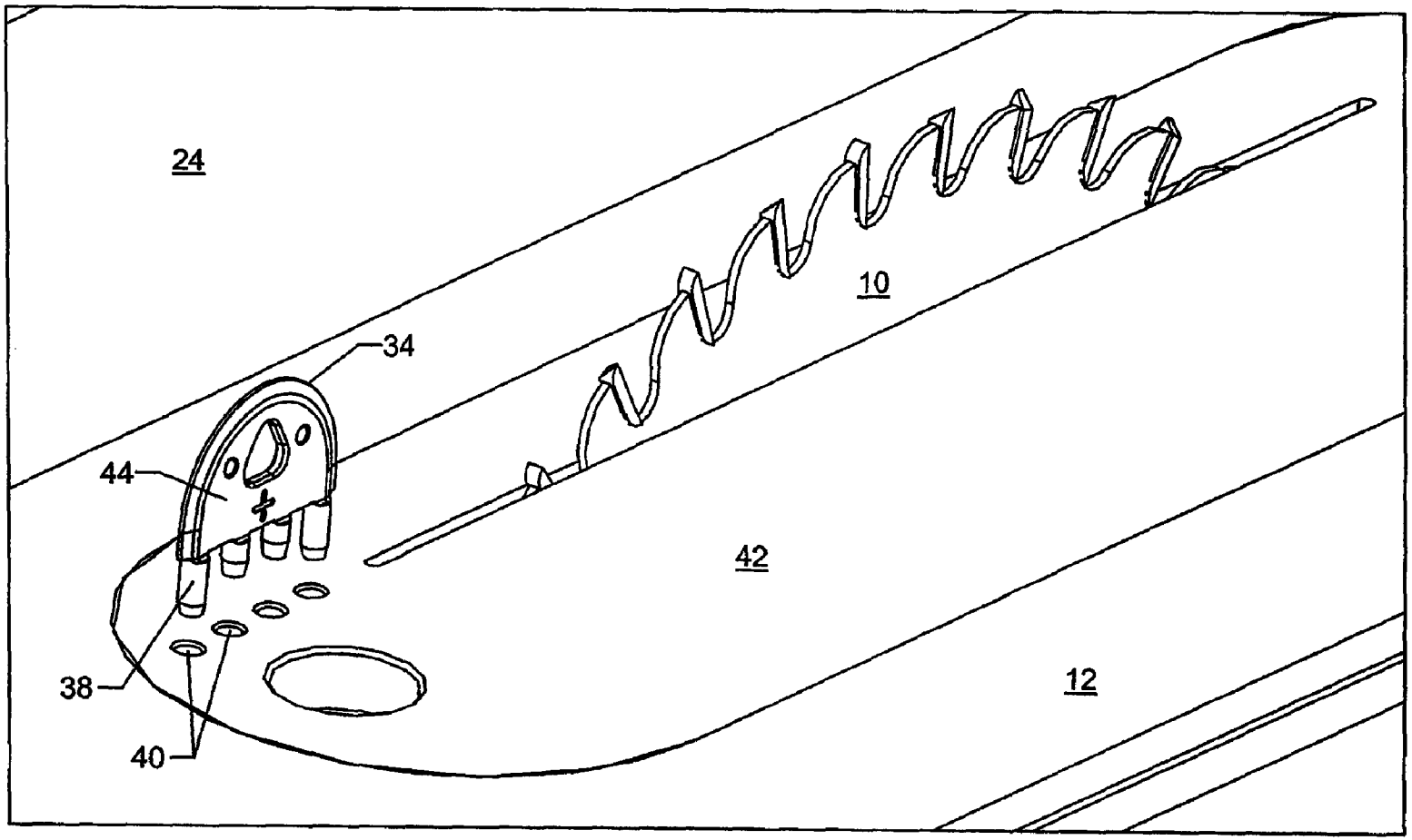
FIG. 3 is a perspective view of a splitter being installed into splitter location holes in a zero clearance insert of a table saw.

FIG. 2 illustrates a kit 30 containing a plurality of splitters 32*a*, 32*b*, 34*a*, 34*b* (sometimes referred to collectively with only numeral 32 or 34) and an installation drill guide 36 that is used to locate holes for mounting the splitters during use. As illustrated in FIG. 3, each splitter 32 contains a plurality of pegs 38 that are removeably inserted into a respective plurality of holes 40 drilled into the work piece support surface directly behind the saw blade 10. For most common table saw designs where a zero clearance insert (ZCI) 42 is installed, the holes 40 are drilled into the ZCI 42 that forms part of the work piece support surface. In an aspect of the present invention, the drill guide 36 is used to index the holes 40 relative to one side of an actual kerf created by the saw blade 10 rather than relative to the saw blade 10 itself. A generally planar work piece contacting portion 44 of the splitters 32 extends vertically from the pegs 38, with the planar portion 44 being parallel to and offset at a known location relative to a centerline of the pegs 38. In this manner, when the splitter 32 is installed into holes 40, the planar portion 44 of the splitter is precisely and repeatedly located relative to the side of the kerf with a known amount of offset, regardless of the actual width of the saw blade or the actual amount of vibration generated during use of the blade. The embodiments illustrated herein all include a plurality of pegs 38 and a respective plurality of holes 40 having a generally circular cross-section.

In one embodiment of the present invention, splitters 32*a*, 32*b*, 34*a*, 34*b* having differing offset distances between the planar portion 44 and the centerline of the pegs 38 are provided, as indicated by the designations "0", "+", "++" and "+++" marked on the splitters 32*a*, 34*a*, 34*b*, 32*b* respectively. In this manner, a desired degree of interference may be created between the planar portion 44 and the side of the actual kerf. When the splitter 32 is formed of an impact resistant material such as an injection molded polycarbonate material (a plastic material with inherent material characteristics that create a rigid springy effect when desired), the selected degree of interference between the splitter 32 and the work piece provides a desired amount of force urging the work piece away from the saw blade 10.

In a further embodiment, a single splitter 32 may be formed to have a first planar work piece contacting surface 44 that is a first distance from the centerline of the pegs 38, and to have a second planar work piece contacting surface 46 opposed the first planar surface 44 that is a second distance from the centerline of the pegs 38 and different than the first distance. When the number and orientation of the pegs 38 is symmetrical to the axis of the kerf, a single splitter 32 may be installed reversibly into the holes 40 to provide two different degrees of interference. Thus, splitters 32*a* and 32*b* may be identical but are viewed in FIG. 2 from opposed sides. Similarly, splitters 34*a* and 34*b* may be identical to each other but with offsets that are different than splitters 32*a* and 32*b*. Kit 30 may be provided with any number of splitters, for example two different reversible splitters providing four options for the offset distance. The splitters illustrated in the drawings include four pegs 38, however, other embodiments having any different number of pegs may be used as appropriate for a particular design. The inventor has used a four-peg embodiment for a relatively thin splitter and a three-peg embodiment for a thicker splitter where somewhat less mechanical support is needed for the planar portion of the splitter. One skilled in the art will also appreciate that other embodiments are possible wherein the cross-section of such parts is not circular, wherein the number of holes and the number of pegs is not equal such as to provide in-line position flexibility, where only one peg of any cross-sectional shape is used such square, triangular or key shaped, wherein the position of the male and female components are reversed or are alternated, etc., provided that the planar portion of the splitter is positioned at a known location relative to the hole(s).

Figure 4:
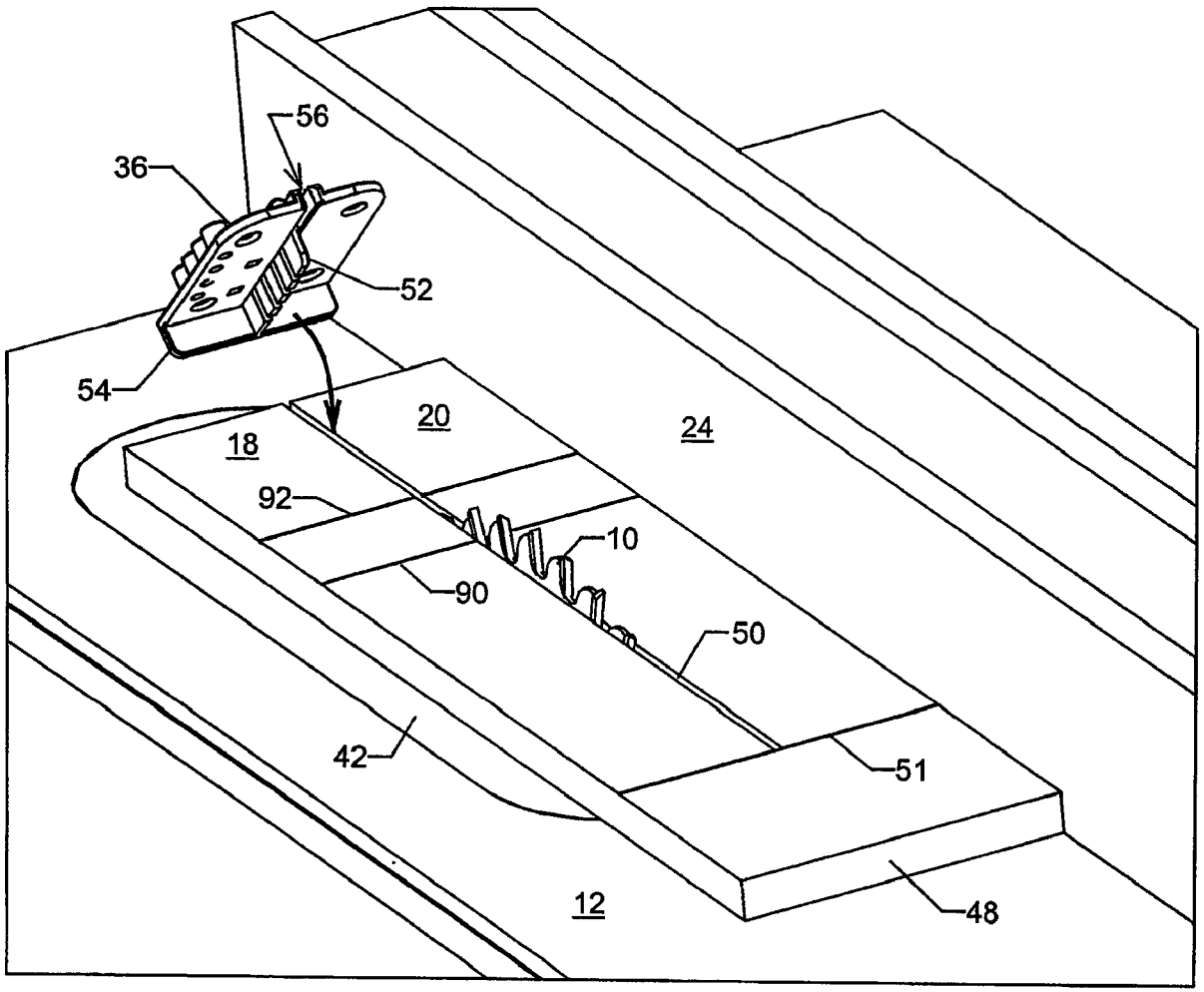
FIG. 4 is a perspective view of a drill guide being installed onto a setup board.
Figure 5:
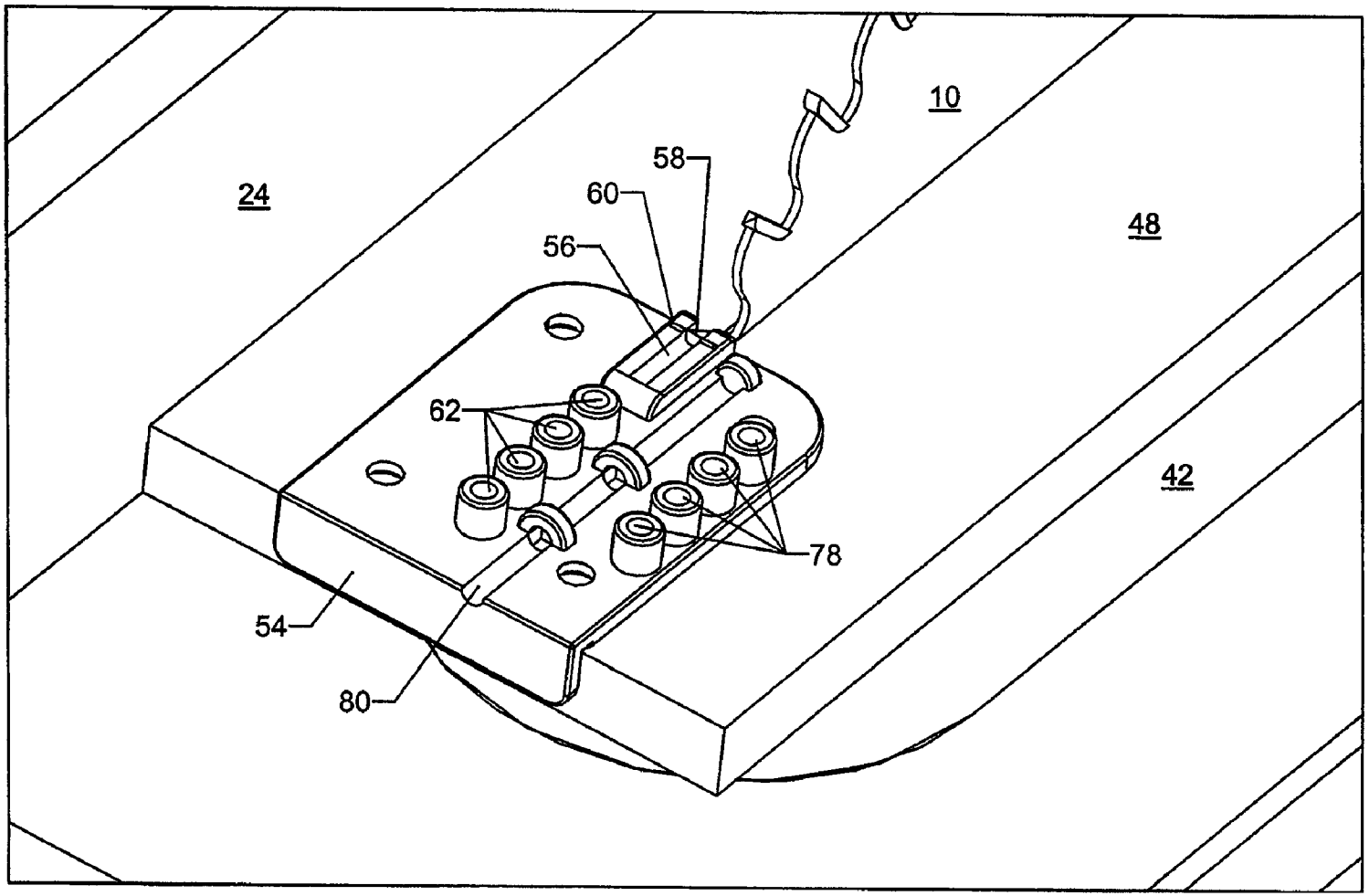
FIG. 5 is a perspective view of the drill guide positioned on the setup board.

A method of installing splitter 32 is now described, beginning with steps illustrated in FIG. 4. A setup board 48 is provided having known dimensions. The board may be a flat piece of dimensionally stable plywood or a medium density fiberboard or other flat material suitable for the steps described below. A saw kerf 50 is cut into the setup board 48 but only to a limited distance, such as to a line 51 drawn on the board 48 approximately three inches from the uncut end of the board. The length of uncut board should be sufficient to provide support for the off-cut piece 18 and keeper piece 20 to maintain the kerf 50 in position. Because the actual kerf 50 that is made by the saw blade 10 is used in later steps to position the drill guide 36, it is important that the setup board 48 be kept in contact with the fence 24 while the cut is being made and that the fence 24 is parallel to the saw blade 10. The power to the saw may be disconnected for safety during the following steps. The saw blade 10 is raised to its highest position and the drill guide 36 is positioned on the end of the board 48 with its downwardly extending center rib 52 positioned into the kerf 50, as shown in FIG. 4, and with its rear wall 54 abutting the cut end of the board 48, as shown in FIG. 5. The board 48/guide 36 are then moved toward the saw blade 10 so that one of the teeth of the blade 10 enters the front opening slot 56 of the guide 36. Positioning of the guide 36 may be achieved when the tip of a first exposed one of the saw blade teeth 58 is aligned with an alignment mark 60 on the top of the guide 36. With the setup board 48 having a predetermined thickness and the drill guide 36 having known dimensions, this process will establish the distance of the guide holes 62 behind the saw blade 10 when the blade is fully raised. As will be described more fully below, the position of the guide holes 62 determines the later location of an installed splitter. It is know to position a splitter as close to the saw blade as practical. The location of the alignment mark 60 is selected to ensure that the saw blade 10 will not come into contact with an installed splitter during use. Methods other than the use of an alignment mark 60 may be used to establish a desired position of the guide 36/guide holes 62/splitter.

Figure 6:
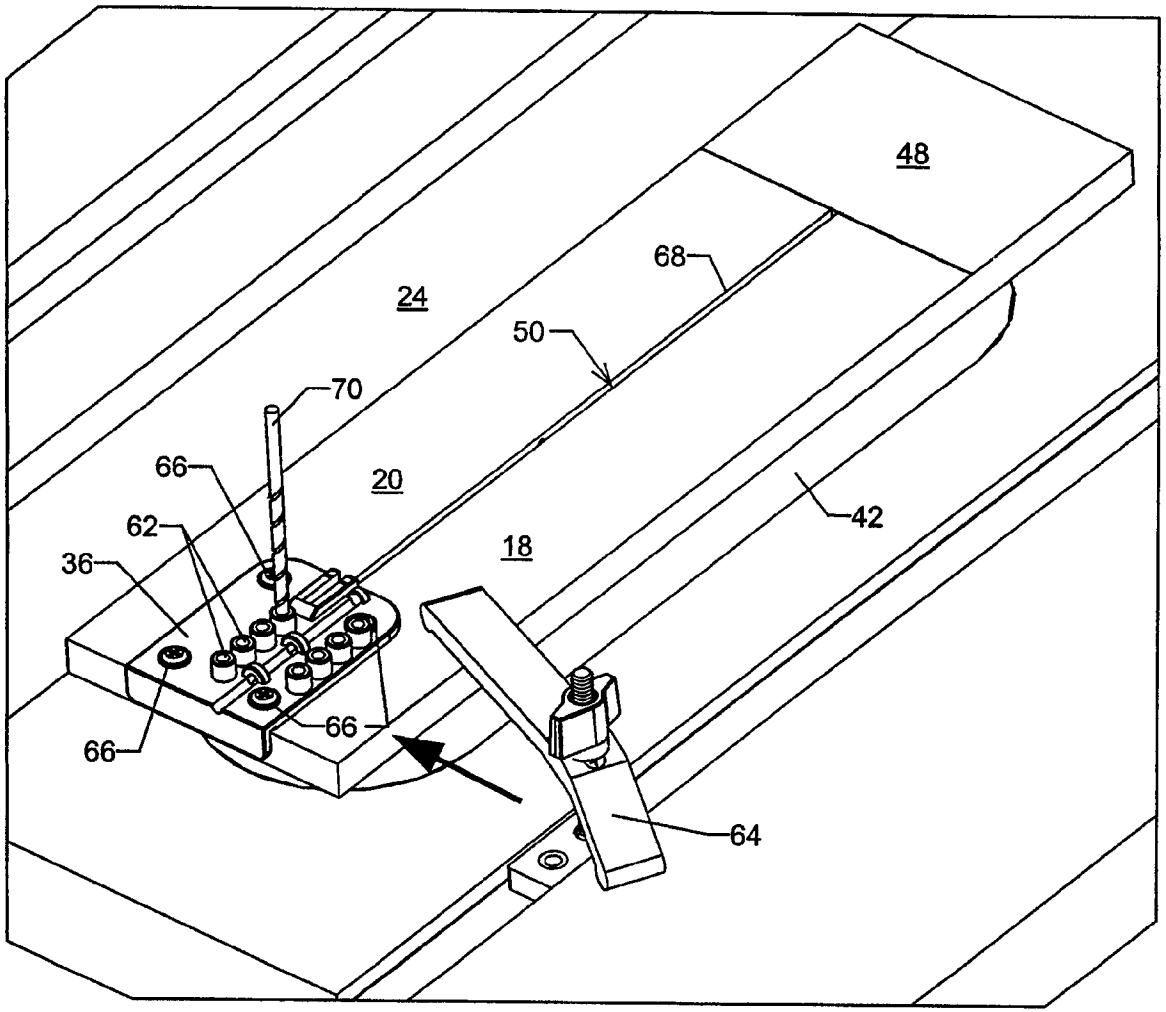
FIG. 6 is a perspective view of the drill guide in position for drilling of the splitter location holes.

The saw blade 10 is then lowered without altering the position of the setup board 48, and the setup board 48 is secured into position, such as with clamp 64 shown in FIG. 6. The clamp 64 should be fastened against the setup board 48 while applying firm finger pressure or feather board pressure from the side of the board 48 away from the fence 24 in a direction toward the fence 24, as indicated by the arrow in FIG. 6. This will ensure that the right edge (as viewed from the perspective of a person operating the saw) of the center rib 52 of the drill guide 36 is in full contact with the right edge of the kerf 50. Due to the construction of the guide 36, this will also align the centers of the guide holes 62 at a predetermined fixed distance from, and in a line parallel to, the right edge 68 of the kerf (the actual cut edge 68 of the keeper piece 20) regardless of any variation in the saw blade thickness or any vibration-induced widening of the kerf 50.

The drill guide 36 is then secured to the setup board 48 using mounting screws 66, and then splitter location holes 40 are drilled into the ZCI 42 by inserting a drill bit 70 through each of the guide holes 62. Care should be taken to keep the drill bit 70 perpendicular to the top surface of the work piece during the drilling process to ensure precise positioning of the splitter location holes 40. The guide holes 62, drill bit 70 and the pegs 38 preferably have the same diameter for an accurate installation and precision in the use of the device. The thickness of the material of the guide 36 and the board 48 help to maintain the stability and verticality of the drill bit 70, since the material that surrounds and defines the elongated guide holes 62 will tend to support the drill bit 70 in a vertical orientation. In the illustrated embodiment of drill guide 36, the guide holes 62 have a diameter that is larger than the width of center rib 52, thereby allowing the guide four holes 62 to segment the center rib 52 into five sections. This exposes the board 48 to the drill bit 70 and allows the right and left kerf edges of the set-up board 48 which are now in direct firm contact with the opposing segmented surfaces of the center rib 52 to function as part of the support for the drill bit 70 during the drilling operation. In other embodiments the diameter of the guide holes may be smaller than the width of the center rib, thereby allowing the drill bit to pass entirely through the kerf of the board within the confines of the center rib. The result of the above steps is that the splitter location holes 40 are referenced from the actual cut edge 68 of the keeper piece 20 rather than from a side or center of the saw blade 10, thereby eliminating inaccuracies in splitter location related to variations in saw thickness and saw blade vibration. The clamp 64 is then released and the entire setup is removed, and the ZCI 42 is ready to receive a splitter.

Figure 7:
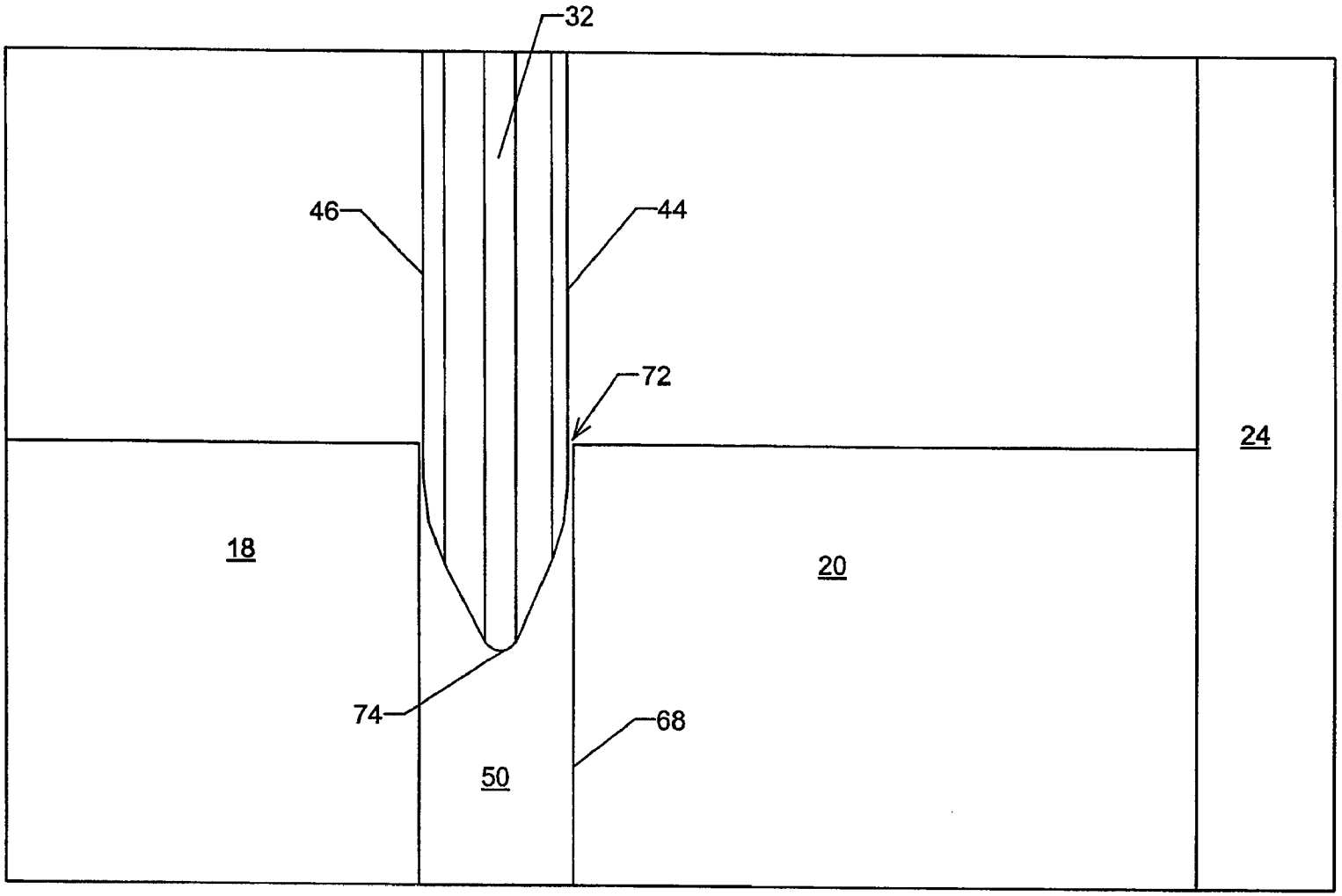
FIG. 7 is a top view of a first configuration of a splitter illustrating the relative locations of the splitter planar surface and the cut edge of the kerf.
Figure 8:
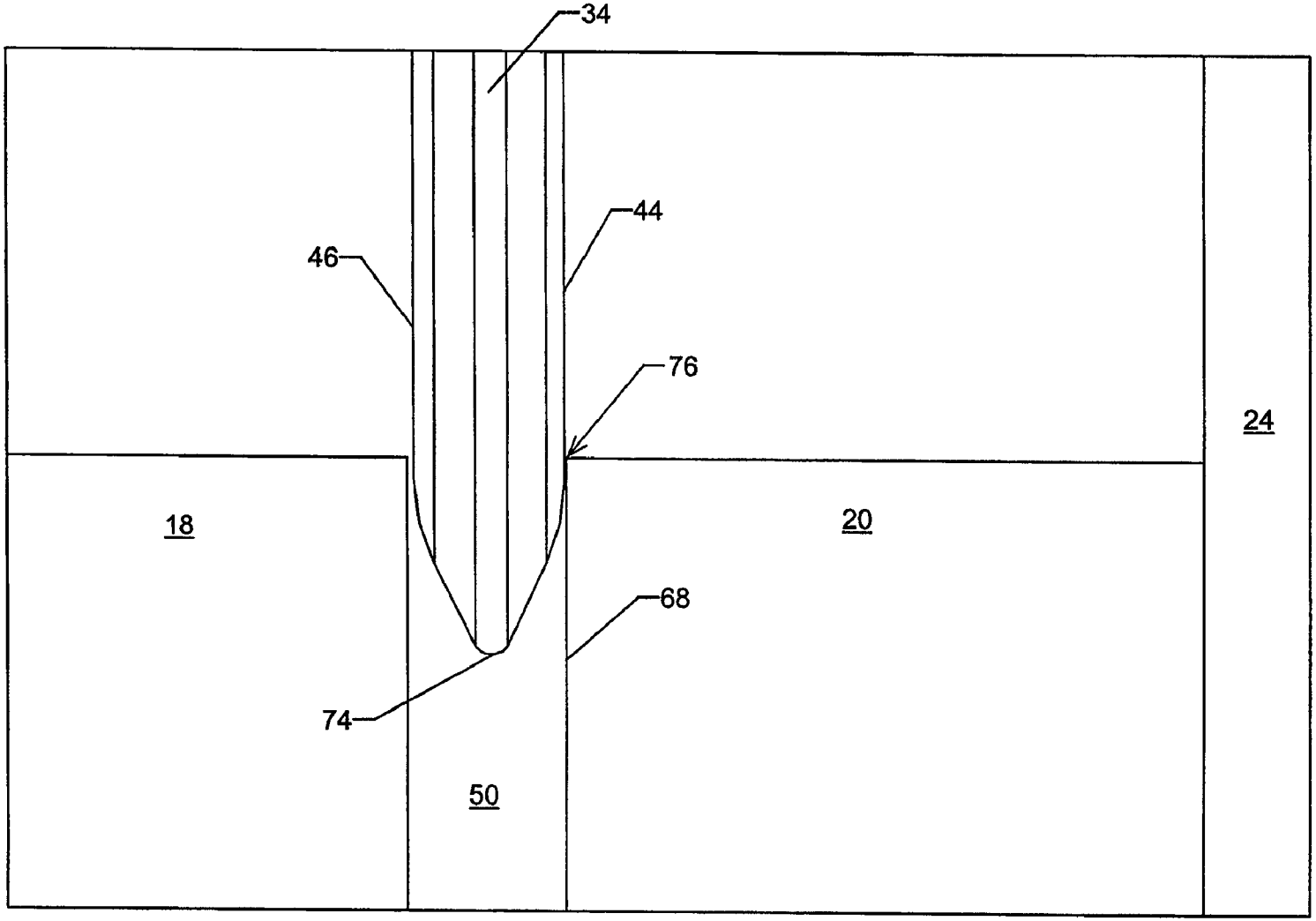
FIG. 8 is a top view of a second configuration of a splitter illustrating the relative locations of the splitter planar surface and the cut edge of the kerf.
Figure 9:
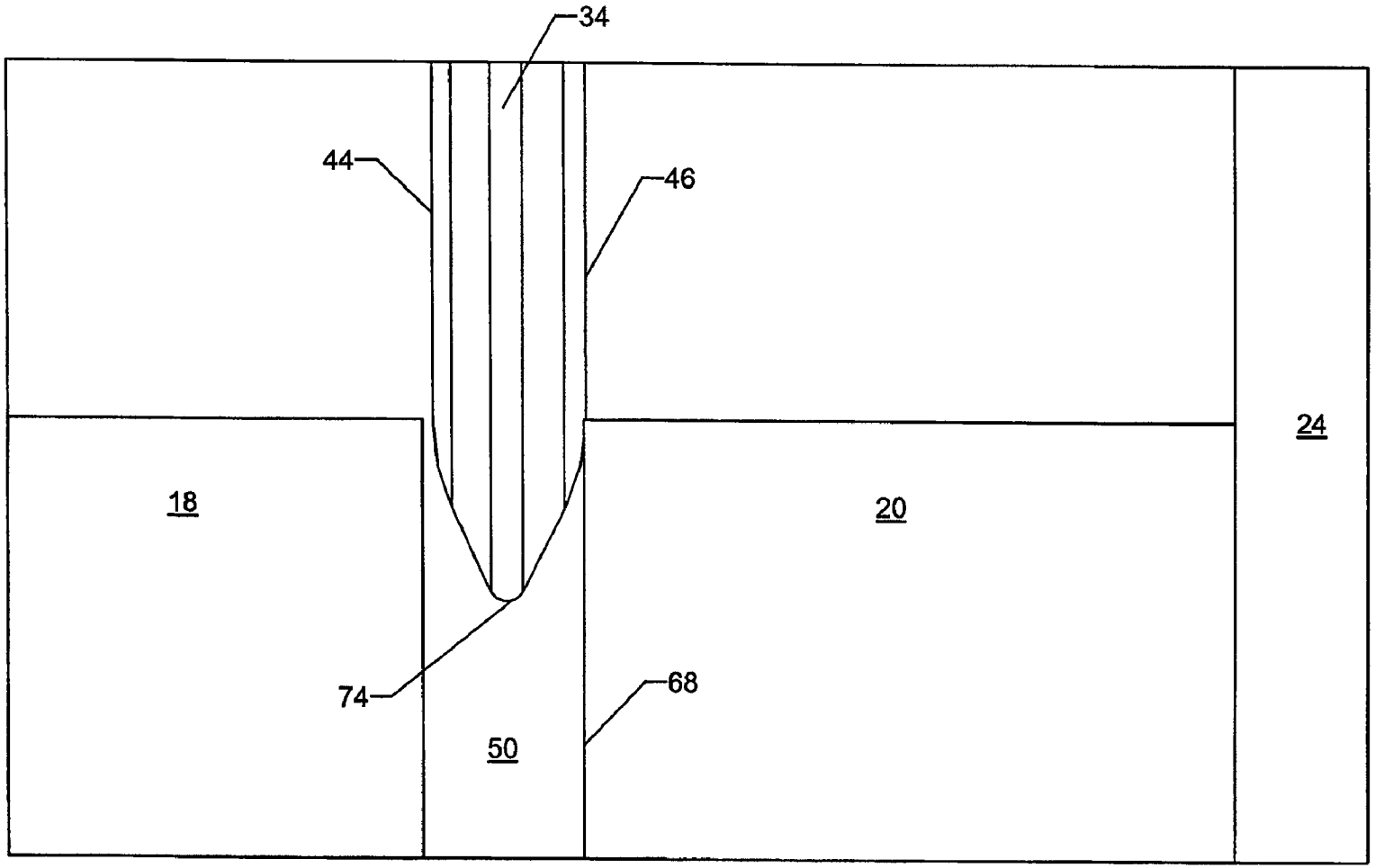
FIG. 9 is a top view of a third configuration of a splitter illustrating the relative locations of the splitter planar surface and the cut edge of the kerf.

The pegs 38 of a splitter 32 are inserted into splitter location holes 40 in preparation for using the splitter 32 during a cutting operation. As discussed above with respect to splitters 32*a*, 32*b*, 34*a* and 34*b*, a plurality of different splitters may be provided to fine tune the precise location of the planar surface 44 with respect to the actual edge 68 of the kerf 50. FIGS. 7, 8 and 9 illustrate splitters with different offset distances being installed with respect to the same kerf 50, off-cut piece 18 and keeper piece 20. FIG. 7 illustrates one embodiment wherein the first planar surface 44 of the splitter is positioned the closest to the centerline of the pegs 38, such as may be embodied in a splitter 32 with its side marked as "0" positioned on the right side. In this embodiment there may exist a small gap between first planar side 44 and the cut edge 68 of keeper piece 20. Note that the leading edge 74 of the splitter may be tapered to facilitate movement of work pieces past the splitter. FIG. 8 illustrates an embodiment wherein the first planar surface 44 is positioned somewhat farther from the centerline of the pegs 38 than in FIG. 7, such as may be embodied in splitter 34 with its side marked as "+" being positioned on the right side. In this embodiment there may exist a very small gap 76 or no gap at all may exist between first planar side 44 and the cut edge 68 of keeper piece 20. In one embodiment there is a 0.003" difference in size between gap 72 and gap 76; i.e. between the location of the "+" side of splitter 34 verses that of the "0" side of splitter 32 relative to the centerline of the pegs 38. FIG. 9 illustrates an embodiment wherein the splitter 34 is rotated 180° compared to its position in FIG. 8. The second planar surface 46 marked as "++" is positioned even farther from the centerline of the pegs 38 than the first planar surface 44. In this embodiment the edge 68 of the kerf 50 interferes slightly into the planar surface 46, thereby slightly bending the planar surface 46 and creating a slight force pressing against the edge 68, like a mini feather board. This force tends to keep the keeper piece 20 against the rip fence 24, resulting in a safer cut. In one embodiment there is a 0.003" difference between the location of the "++" side of splitter 34 verses that of the "+" side of splitter 34 relative to the centerline of the pegs 38. One may envision that any desired amount of interference may be achieved between the splitter and the cut edge of the work piece by providing an appropriately configured splitter having a desired amount of offset between its planar surface and the centerline of its installation pegs. The difference in offset between different splitters may be any particular distance; for example, another embodiment may have a 0.002" difference between two different splitters. The amount of force exerted on the work piece as a result of the interference can also be affected by the material of construction and the mechanical design of the splitter, thus providing additional flexibility in the splitter design and selection process. This invention facilitates the easy installation and removal of a splitter so that the operator can make micro incremental offset adjustments to provide the particular amount of force desired for a particular cut. As the cut edge of a board moves past the splitter, the operator will be able to feel the work piece make contact with the splitter, thereby providing feedback that the splitter offset is correct and that a desired amount of force is being applied to the side of the kerf. Too little or too much interference may be detectable by the operator once he/she gets the "feel" of the device, thereby providing a reassuring feedback signal to the operator when the setup is correct.

Kit 30 of FIG. 2 may be provided with any variety of such differently configured splitters. Kit 30 may also include appropriate hardware such as drill bit 70 and mounting screws 66. For splitters having a symmetric peg arrangement, reversible splitters may be provided having two opposed planar surfaces 44, 46, such as a "+" on one side and a "++" on the opposed side, or a "0" on one side and a "+++" on the opposed side. The thickness of the generally planar portion of the splitter that defines these opposed work-piece contacting surfaces may be the same for splitters having different combinations of offset distances, with the difference between splitters being accomplished by differing the location of the planar portion relative to the centerline of the pegs. Alternatively, the difference in the offset between two splitters may be accomplished by providing generally planar portions having different thicknesses. Once the ZCI 42 is drilled, a variety of applications may be accommodated by simply removing one splitter from the splitter location holes 40 and installing a preferred splitter configuration. When not in use, the splitter 32 may be stored with the drill guide 36 by inserting the splitter pegs 38 into the guide holes 62. Storage for a second splitter may be provided via storage holes 78, and storage for the drill bit 70 may be provided via storage slot 80, as most clearly seen in FIG. 5.

Figure 10:
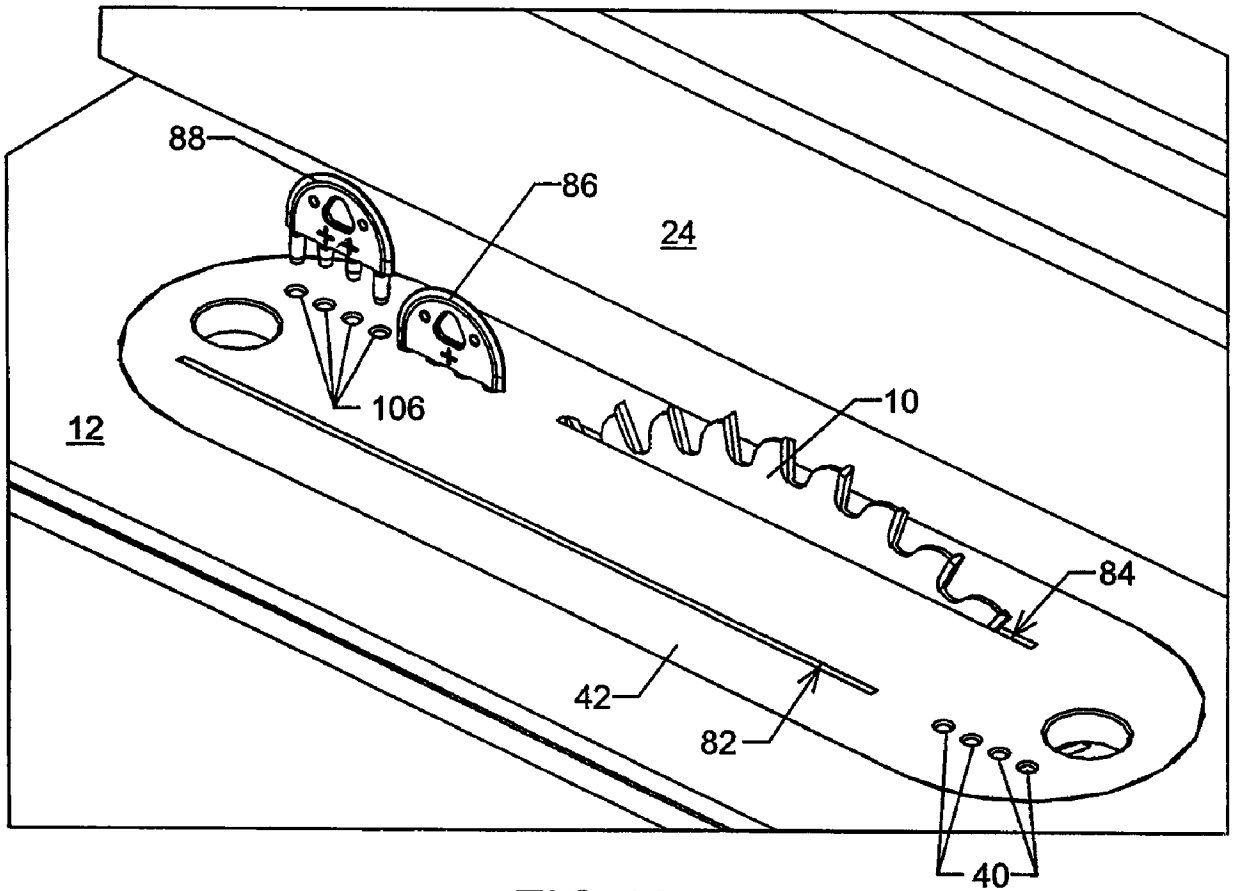
FIG. 10 is a perspective view of a zero clearance insert configured for two heights of saw blades; one configuration utilizing a single splitter and the other configuration using dual splitters.

FIG. 10 illustrates another embodiment of the present invention. The zero clearance insert 42 in this embodiment can be installed in either of two directions rotated 180° from each other so that the saw blade 10 can be made to protrude between either of two saw slots 82, 84. A plurality of splitter location holes 40 have been drilled into the ZCI 42 in association with the first saw slot 82 that extends a sufficient distance to accommodate the saw blade 10 in its highest position for cutting the thickest stock material. A second saw slot 84 is made in the reversible ZCI 42 to receive the saw blade 10 in only a partially raised position for cutting thinner stock material. A first splitter 86 is installed downstream of the saw slot 84 for making contact with the right side (keeper piece side) of the kerf to urge the keeper piece toward the rip fence 24. A second splitter 88 is installed downstream of the first splitter 86 for making contact with the left side (off-cut piece side) of the kerf. Alternatively, the first splitter 86 could be installed to make contact with the left side of the kerf and the second splitter 88 could be installed to make contact with the right side of the kerf, which may be preferred if the rip fence is located on the left side of the blade 10. In the embodiment of FIG. 10 both splitters 86, 88 are installed on the ZCI 42, although other embodiments may utilize one or two splitters installed on any appropriate region of a work piece support surface, whether or not the surface includes a zero clearance insert.

The installation of dual splitters 86 and 88 will now be described. Splitter 86 may be installed in a manner similar to that described above with respect to FIGS. 3-9. One will appreciate, however, that if there is an alignment mark 60 on the splitter that is designed for marking the location of a splitter relative to a fully raised saw blade 10, it is likely that the alignment mark 60 would not be appropriate for use with the same blade 10 being used in a partially raised position, such as with shorter saw slot 84. This is because the first exposed tooth of the saw is closer to the center of the saw blade 10 for a lowered saw blade 10 than for a fully raised blade. Therefore, there would be a greater chance that the saw blade 10 would interfere with the guide holes 62 or pegs 38 when using the alignment mark 60 with a lowered blade. This may require the splitter to be located farther away from the end of saw slot 84 with a partially lowered saw blade 10 than would otherwise be necessary with the saw blade 10 fully raised in order to avoid the possibility of the saw blade 10 damaging the splitter pegs 38. So while the overall method of installation described above may be used for splitter 86, the step of aligning the guide 36 with the tip of the first saw tooth 58 may need to be replaced by an alternative method of alignment. Such an alternative method may include marking two additional alignment lines 90, 92 on setup board 48, as illustrated in FIG. 4. In lieu of aligning the tip of the saw tooth 58 with the alignment mark 60, as illustrated in FIG. 5, the tip of the saw tooth 58 may be aligned with alignment line 92 for the installation of splitter 86. The location of alignment line 92 is selected to ensure that the saw blade does not intersect the subsequently drilled splitter location holes during use of the splitter 86, while at the same time keeping the splitter 86 as close to the saw blade 10 as practical. Thus, the method described above may be used with this one modification to install splitter 86 for making contact with the keeper piece side of the kerf.

Figure 11:
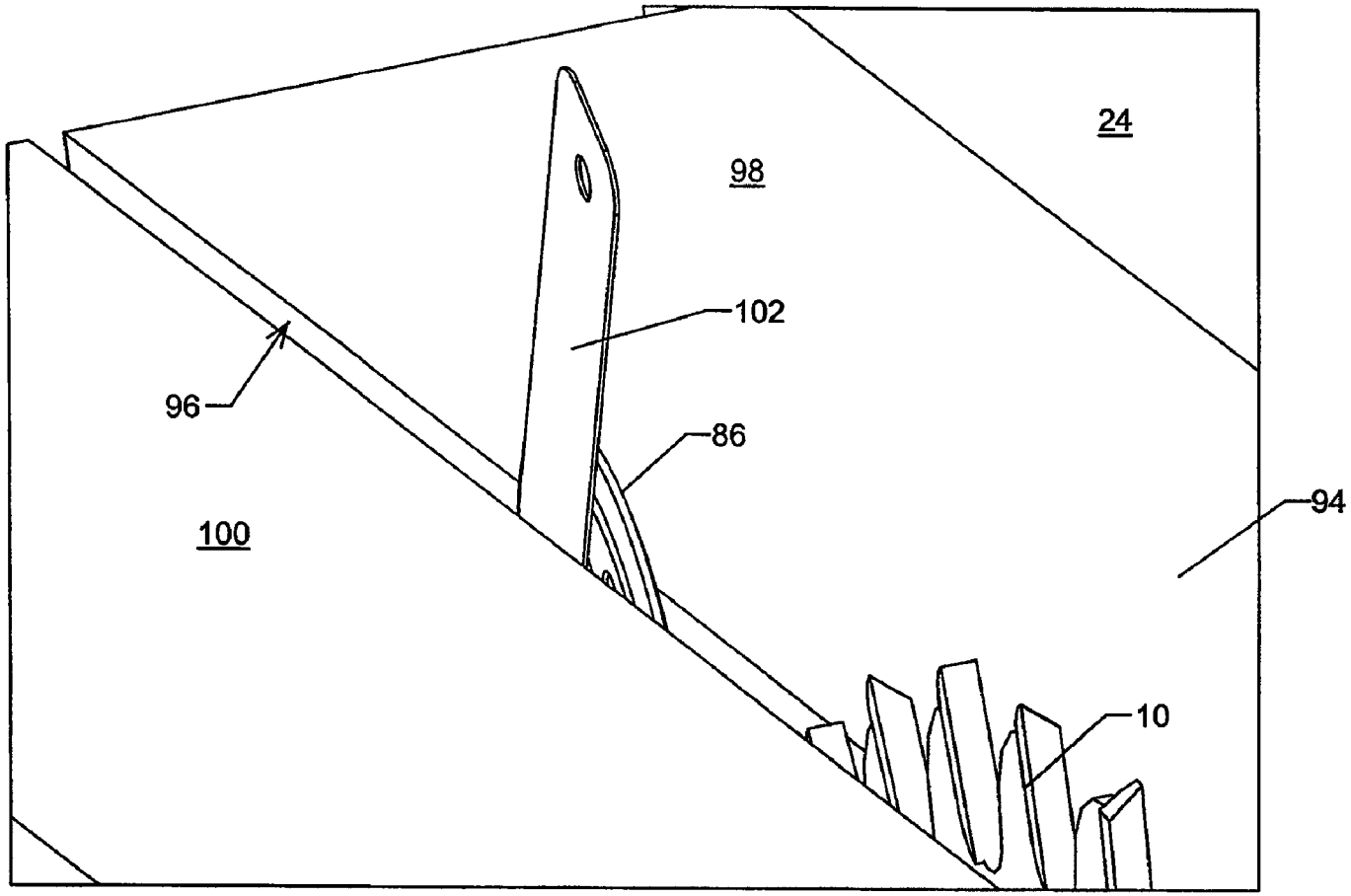
FIG. 11 illustrates the use of a feeler gauge to measure the gap between a splitter and an opposed side of the kerf.
Figure 12:
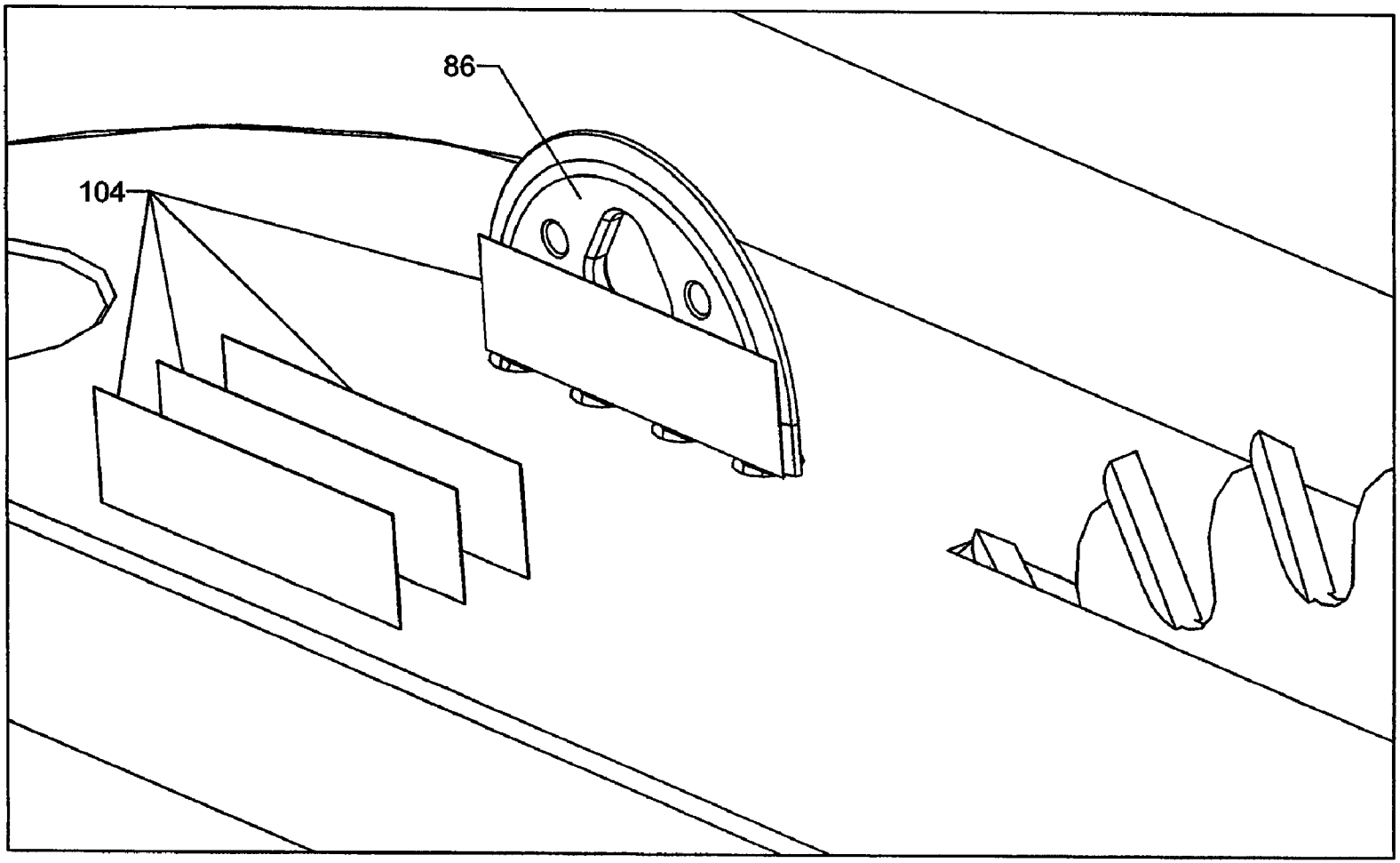
FIG. 12 illustrates the application of masking tape to a splitter to fill the gap measured in FIG. 11.
Figure 13:
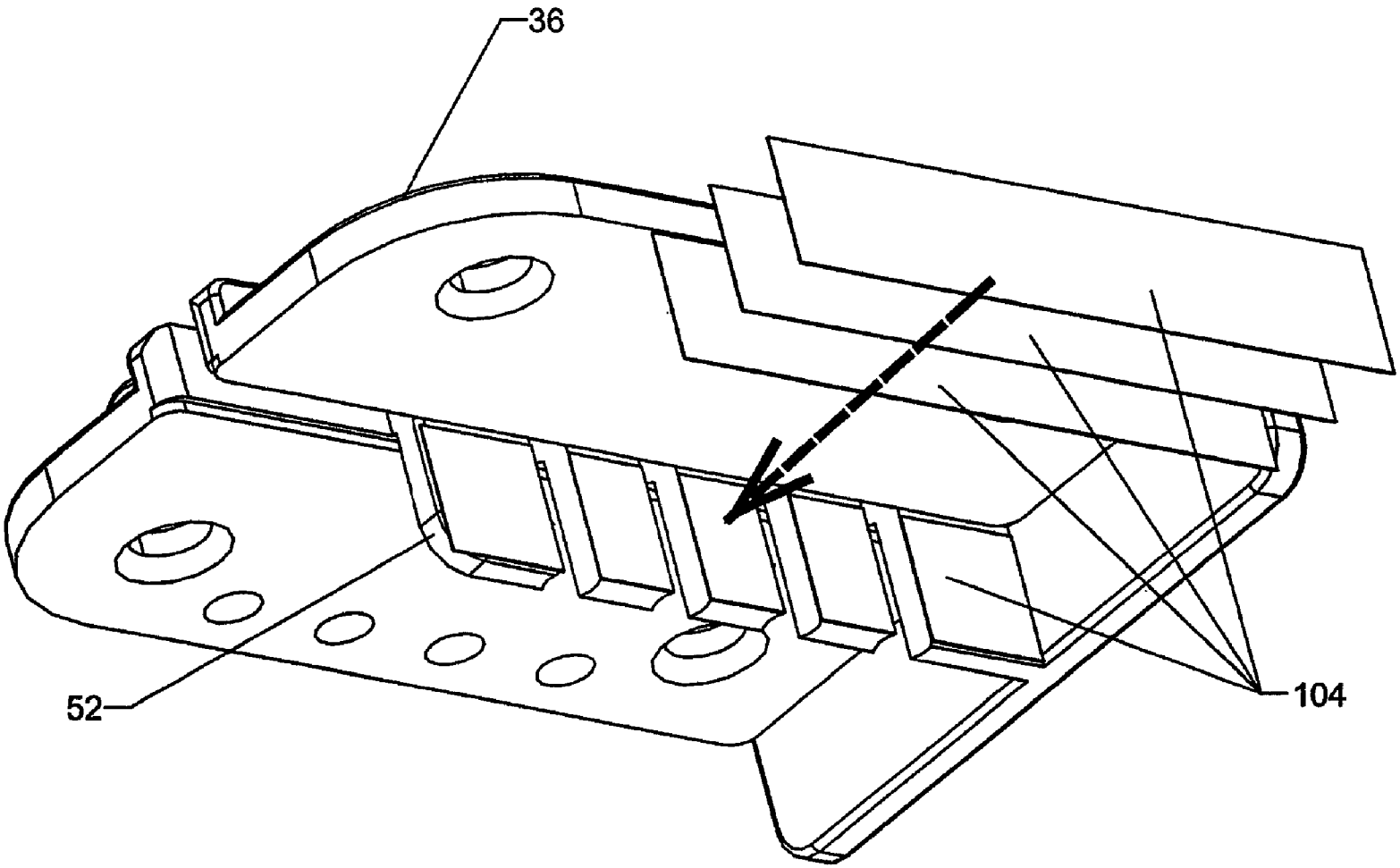
FIG. 13 is a perspective view of a drill guide showing the application of masking tape to the center rib.
Figure 14:
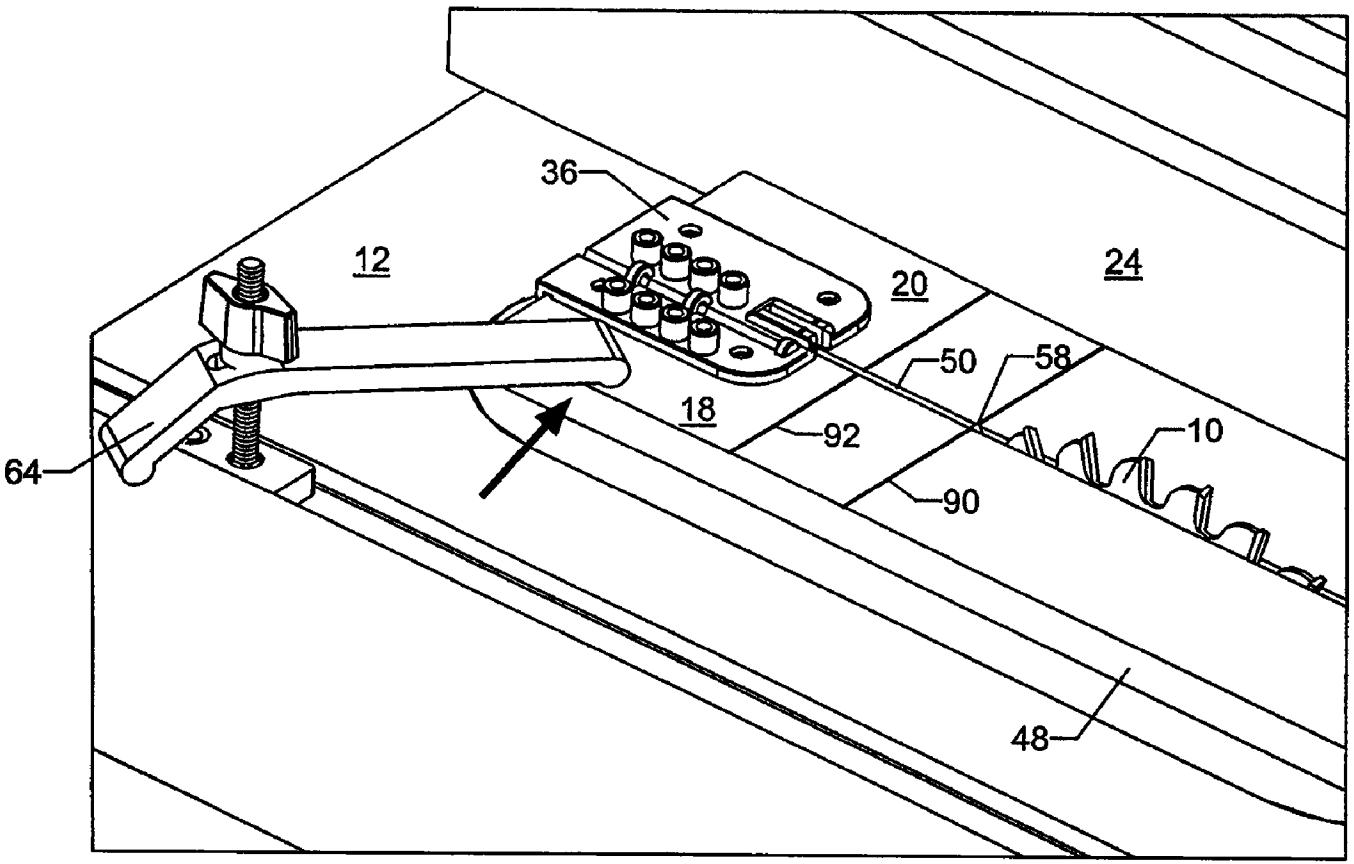
FIG. 14 is a perspective view of the installation of the taped drill guide of FIG. 13 being installed on a setup board.

A process for installing splitter 88 to make contact with the off-cut side of the kerf will now be described, beginning with FIG. 11. With splitter 86 installed, a second set-up board 94 similar to set up board 48 is cut, leaving a sufficient uncut length (not shown) to retain the kerf 96 in position. The cut may be made with a "0" side of the splitter facing the rip fence 24, and then, with the saw blade 10 stopped, splitters with different offsets may be tried until a desired degree of interference is achieved between the splitter 86 and the keeper piece 98. In this manner, there will be contact between the splitter 86 and the keeper piece 98, and there will be a small gap between the splitter 86 and the off-cut piece 100. The second splitter 88 will eliminate this gap in order to provide a safer and cleaner cut. The size of the gap is measured, such as with a feeler gauge 102. The second set up board 94 is then removed, and a material is added to the left side (gap side) of the splitter 86 in a thickness equal to the measured gap width. The inventor has found that masking tape 104, which has a thickness of about 0.004" per layer, is useful for this purpose. If a feeler gauge 102 is not available, one layer of material such as masking tape 104 at a time may be applied to the side of the splitter 86 and the set up board repositioned repeatedly until the gap is completely filled. Once the correct thickness of material (number of layers of masking tape 104) is determined, that same thickness (number of layers of masking tape 104) is applied to the right side (keeper piece side) of the center rib 52 of drill guide 36, as illustrated in FIG. 13. The first set up board 48 is then repositioned on the ZCI 42 and the work surface 12 and the drill guide installed onto the end of the board 48 with the center rib 52 inserted into the kerf 50, as illustrated in FIG. 14. The presence of the masking tape 104 causes the drill guide 36 to be moved away from the right side of the kerf 68 by the amount of the measured gap when compared to the similar installation step illustrated in FIGS. 5 and 6. The board 48 is then moved to a position where the tip of the saw blade 58 is aligned with alignment line 90, and clamp 64 is then applied while a finger pressure is exerted against the off-cut piece 18. Note that alignment line 90 is positioned a desired distance away from alignment line 92 in order to provide a desired spacing between the two splitters 86, 88. Mounting screws 66 are then installed to further secure the position of drill guide 36 and splitter location holes 106 for splitter 88 are drilled through guide holes 62 as described above. A splitter 88 with the desired amount of offset is then selected to provide a desired degree of force against the off-cut piece during use of this dual-splitter embodiment. The use of two splitters to control both sides of the kerf is especially advantageous with large sheet stock being cut on a table saw, since force applied by the left hand to keep the sheet stock against the rip fence will often cause the off-cut piece to be pushed against the rear portion of the saw blade, thus causing burn marks and/or kickback.

One skilled in the art may appreciate that the concepts described above may be implemented in devices having any variety of dimensions depending upon the particular application. The material of construction of the drill guide may be metal, plastic or other sufficiently durable material. The material of construction of the splitters should be one providing a desired degree of flexibility for exerting a force on the work piece when deformed due to the interference between the splitter and the edge of the kerf. In one embodiment, both the drill guide and the splitters are injection molded from polycarbonate material. Other methods of alignment of the location of the splitter location holes 40 may be envisioned, such as using a laser alignment device to index the holes from an edge of an actual kerf created by the saw blade 10. Other methods of creating the splitter location holes 40 may be used, such as using a laser cutting device which may be especially useful for non-circular holes.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. An apparatus for use with a table saw comprising:

a splitter work piece contacting surface; and a means for selectively positioning the splitter work piece contacting surface to an incrementally selectable amount of offset parallel to a blade of a table saw in order to create one of a plurality of selectable degrees of interference between the splitter work piece contacting surface and a keeper piece of a work piece for urging the keeper piece against a rip fence of the table saw and away from the blade with a desired amount of force.

2. The apparatus of claim 1, wherein the means for positioning further comprises a plurality of pegs insertable into respective holes formed in a top of the table saw, the work piece contacting surface extending vertically above the holes from the pegs, with the work piece contacting surface being parallel to and offset relative to a centerline of the pegs.

3. An apparatus for use with a table saw comprising:

a generally planar portion comprising a first work piece contacting surface;

a support element positioning the generally planar portion within a kerf created in a work piece by a blade of a table saw at an incrementally selectable distance from a rip fence of the table saw and parallel to the blade to create a controlled degree of interference between the first work piece contacting surface and a keeper piece of the work piece for urging the keeper piece against the rip fence of the table saw with a desired amount of force.

4. The apparatus of claim 3, further comprising a second work piece contacting surface opposed the first work piece contacting surface, the first and second work piece contacting surfaces being offset from the support element by different respective and opposed distances so that the degree of interference and desired amount of force is incrementally selected by selecting a direction of installation of the apparatus such that a chosen one of the first and second work piece contacting surfaces is in contact with the keeper piece when the generally planar portion is positioned within the kerf.

5. The apparatus of claim 4, wherein the support element comprises a plurality of pegs disposed along a peg centerline and extending vertically from the generally planar portion, wherein the first and second work piece contacting surfaces are disposed at respective different first and second distances from the peg centerline.

6. An apparatus for use with a table saw comprising:

a work piece contacting member of the apparatus;

a means for positioning the work piece contacting member within a kerf created between a keeper piece and an off-cut piece of a work piece as the work piece is moved through the blade of a table saw with an incrementally selectable amount of offset between the work piece contacting member and an edge of the keeper piece while remaining parallel to the blade, with the incrementally selectable amount of offset being effective to create a mini feather board effect pressing the keeper piece against a fence of the table saw with a correspondingly incremental amount of force to cause the movement of the keeper piece to remain parallel to the blade, such that as the edge of the work piece moves through the blade and makes contact with the work piece contacting member, the contact is perceptible to an operator of the table saw, thereby confirming the offset.

7. The apparatus of claim 6, wherein the means for positioning further comprises a plurality of pegs attached to the work piece contacting member and adapted for insertion into a corresponding plurality of holes formed in a top surface of the table saw behind the blade;

wherein the pegs are disposed along a centerline and the work piece contacting member is offset from the centerline;

such that the work piece contacting surface will contact the keeper piece with two different degrees of mini feather board effect depending upon whether the pegs are inserted into the holes in a first order or in an order opposite the first order.

8. The apparatus of claim 6, further comprising:

a plurality of pegs aligned along a centerline and attached to the work piece contacting member, the pegs adapted to be inserted into a respective plurality of holes formed in a top surface of the table saw in either of two directions;

the work piece contacting member comprising a first work piece contacting surface offset from the centerline by a first predetermined distance and a second work piece contacting surface opposed the first work piece contacting surface and offset from the centerline by a second predetermined distance that is micro incrementally different than the first distance;

wherein when the pegs are inserted into the holes in a first of the two directions, the first work piece contacting surface makes contact with the keeper piece with a first degree of offset; and when the pegs are inserted into the holes in a second of the two directions, the second work piece contacting surface makes contact with the keeper piece with a second degree of offset different than the first degree of offset.

* * * * *